United States Patent [19]

Chavy et al.

[11] Patent Number: 4,587,784

[45] Date of Patent: May 13, 1986

[54] FLAME-RESISTING GLAZING PANELS

[75] Inventors: Pierre P. R. Chavy, Mareil Marly; Jean-Claude Legrand, Forges-les-Eaux, both of France

[73] Assignee: Conforglace S.A., Gaillefontaine, France

[21] Appl. No.: 560,392

[22] Filed: Dec. 12, 1983

[30] Foreign Application Priority Data

Nov. 20, 1982 [FR] France ..... 82 21298

[51] Int. Cl.[4] ..... E06B 3/26

[52] U.S. Cl. ..... 52/304; 52/791

[58] Field of Search ..... 52/304, 232, 171, 172, 52/788, 791; 411/501; 217/110

[56] References Cited

U.S. PATENT DOCUMENTS

| | | | |
|---|---|---|---|
| 1,464,523 | 8/1923 | Gerstenberger | 217/110 |
| 2,125,372 | 8/1938 | Fox | 52/304 |
| 2,302,740 | 11/1942 | Boicey | 52/304 |
| 2,359,163 | 9/1944 | Sherts | 52/304 |
| 2,510,693 | 6/1950 | Green | 411/501 |
| 2,805,452 | 10/1957 | Englehart | 52/304 |
| 2,886,864 | 5/1959 | Boicey et al. | 52/304 |
| 2,887,737 | 5/1959 | Prescott | 52/304 |
| 4,203,264 | 5/1980 | Kiefer et al. | 52/232 |

FOREIGN PATENT DOCUMENTS

| | | | |
|---|---|---|---|
| 997856 | 7/1965 | United Kingdom | 52/304 |

*Primary Examiner*—James L. Ridgill, Jr.
*Attorney, Agent, or Firm*—Larson and Taylor

[57] ABSTRACT

The flame-resisting glazing panel comprises at least one flame-resisting glazing 1 and at least one mechanically strong glazing 2 which is spaced from the flame-resisting glazing by a layer of gas 3. The mechanically strong glazing 2 has an aperture 8 through which extends a plug 9–11; 14–16; 18–22; 26–31 which is arranged hermetically and seals the aperture. The plug is made from a material which is fusible at a relatively low temperature of 70° to 150° C.

16 Claims, 7 Drawing Figures

FLAME-RESISTING GLAZING PANELS

The present invention relates to an improvement in flame-resisting glazing or glass panels.

Safety standards in the building industry require in certain cases the use of flame-resisting glazing or glazed or glass panels i.e. glazing capable of resisting fires. Such glazing is for example of utility in buildings of very great height in order to ensure that the breaking of the glazing does not create draught which would activate the fire.

Flame-resisting glazing which may or may not be laminated has already been developed, such as for example glazing termed "athermic" glazing which has a high resistance to heat and an extremely low coefficient of expansion, this glazing being capable of resisting the heat given off by a fire which spreads in the premises that the glazing defines.

For reasons relating to the heat and sound insulation, flame-resisting glazing is often incorporated in complex glazing panels comprising, in addition to the flame-resisting glazing disposed on the side on which the fire is to be feared, one or more simple or compound glazing the different glazings being separated by one or more layers of gas and in particular air which is hermetically trapped between the glazings. Consequently, in the event that the flame-resisting or athermic glazing is subjected to a considerable elevation of temperature, for example owing to a fire, the heat is transmitted to the layer of gas defined thereby and this results in a considerable increase in the pressure in the corresponding hermetic volume. Now, as it is often required to impart to the other glazings of the panel high resistance to mechanical actions, the increase in the pressure finally in this case destroys the flame-resisting glazing and, as the other glazing or glazings of the panel have only a low resistance to heat, the whole panel is rapidly destroyed.

An object of the present invention is to overcome these drawbacks and to provide glazing panels comprising at least one flame-resisting glazing and at least one mechanically very strong glazing separated by at least one layer of gas, in respect of which the increase in the temperature of the layer of gas does not result in an increase of pressure capable of destroying the flame-resisting glazing.

Another object of the invention is to provide such a glazing panel in which the layer of gas is put into communication with the volume opposed to the volume defined by the flame-resisting glazing when the temperature rises beyond values corresponding to normal operation.

Another object of the invention is to provide such a panel in which the hermetic character of the volume defining the layer of gas remains unaltered in normal operation, even after a long period.

A further object of the invention is to provide such a panel which is easy to manufacture and cheap.

The invention provides a glazing panel comprising at least one flame-resisting glazing, defining a volume or premises in which a fire might break out, at least one mechanically strong glazing disposed on the side opposed to said volume or premises in a position parallel to the first-mentioned glazing, with interposition of a layer of gas, for example air, contained in a hermetic internal volume so as in particular to obtain a good sound and/or heat insulation, wherein said mechanically strong glazing is provided with an orifice which is hermetically closed by a plug made from a material which is fusible at a relatively low temperature, preferably of the order of 70° to 150° C.

The fusible material may advantageously be a metal alloy meltable at low temperature, for example an alloy of Wood or a derivative thereof. By way of a modification, this material may also be a thermoplastic and/or thermofusible non-metallic material.

In a first embodiment, said plug may advantageously comprise, on each side of the mechanically strong glazing, two flanges which bear against said glazing, optionally through the medium of sealing elements, the two flanges being interconnected so as to ensure a compression of the sealing elements.

Thus, for example, the plug may comprise a nut of a fusible material provided with a flange which bears, preferably through a non-bonded or non-adherable sealing element, against the inner surface of the mechanically strong glazing, the body of the nut extending through the aperture or orifice of the glazing and receiving by a screwing action a second part of the plug in the form of a screw which is or is not of a thermofusible material, the head of the screw bearing against the outer surface of the glazing by compressing an annular sealing element which is preferably also of a non-bonded non-adherable material.

By way of a modification, the nut may be for example replaced by a thermofusible mass or material which is poured inside a ring so as to trap a rod or an extension of a part which is preferably also thermosfusible and replaces the aforementioned screw and has at the opposite end a flange compressing a sealing element.

In another embodiment of the invention, this time devoid of flanges bearing against the sides of the glazing, the plug may comprise a radially expansible mass or body which is of a thermoplastic material and has a rod extending therethrough, said mass being for example clamped between two flanges disposed on each side and capable of being shifted towards each other by screwing so as to produce a radial expansion of the mass which comes into contact with the cylindrical wall of an aperture formed in the mechanically strong glazing, preferably with interposition of a non-bonded and non-adherable sealing element.

The sealing elements are preferably made from materials such as polyisobutylene.

By "mechanically strong glazing" is meant in the present invention glazing having mechanical resistance to impact, pressure or attacks of the same order as, or higher than, the resistance of the athermic flame-resisting glazing. Such a mechanically strong glazing may be either a single glazing or a composite glazing, i.e. a laminated glazing consisting for example of two glasses separated by a sheet of a transparent synthetic material.

When a fire breaks out in the volume or premises defined by the flame-resisting glazing, the temperature of the latter rapidly increases and this temperature is communicated to the gas enclosed between the athermic glazing and the strong glazing. The temperature and the pressure of said gas rapidly rise and the heat is transmitted to the plug closing the orifice in the mechanically strong glazing. As soon as the temperature of fusion or softening is reached, the plug is unsealed or expelled by the pressure and puts the internal volume of the layer of gas in free communication with the volume outside the mechanically strong glazing so that the flame-resisting glazing is then only subjected to the relatively low pressure difference existing in the premises subjected to the action of the fire and the opposite volume, for example the exterior surroundings. Even after the fusion of the plug, the glazing retains, at least in the major part, its characteristics of resistance to fires and can subsequently be replaced by an equivalent new glazing.

On the other hand, so long as the critical temperature for the plug has not been reached, the volume of gas between the two glazings remains hermetically sealed. This characteristic is particularly important for preventing an introduction of vapour in the layer of gas and maintaining the transparency of the panel.

Further features and advantages of the invention will be apparent from the following description, given by way of a non-limiting example with reference to the accompanying drawing, in which.

Figure 1:
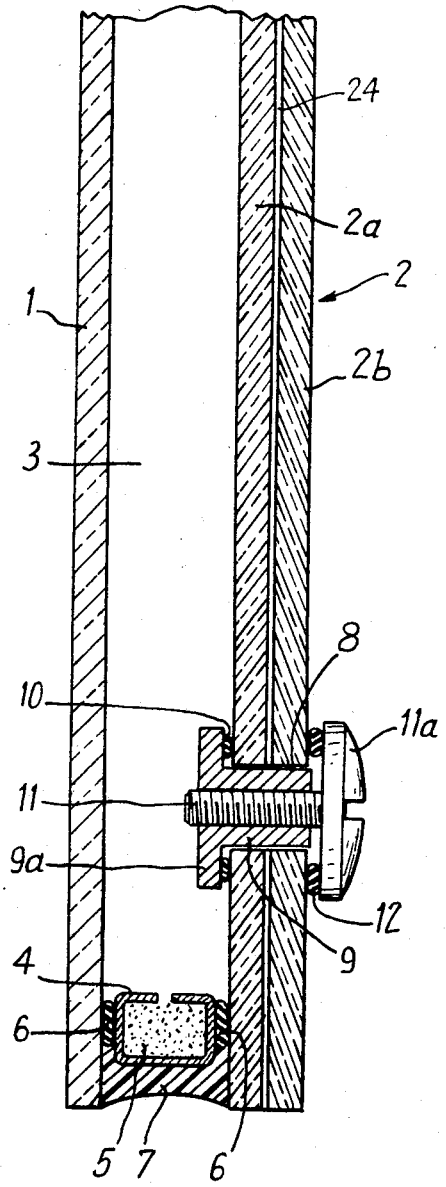
FIG. 1 is a diagrammatic sectional view of a panel according to the invention.

Reference will first of all be made to FIG. 1.

This figure shows a partial sectional view of the lower part of a vertical glazing panel according to the invention. This panel has, on one hand, an athermic glazing 1 made for example from a glass having a thickness of 6 mm. Placed parallel to this glazing 1 is a mechanically strong laminated glazing 2 consisting in fact of two strong glasses *2a* and *2b* each of which has a thickness of 4 mm. A film 24 of a material, such as butyral, having a thickness of 0.8 mm. is disposed between the two glasses *2a* and *2b*. Such a laminated unit has high mechanical resistance to pressure and impacts.

A layer of air 3 having a thickness of 12 mm. is trapped between the two glazings 1 and 2. The panel, which has a rectangular shape, has, on the four sides of the periphery, edges formed by a section member 4 preferably filled with a dessicating material 5 communicating with the layer of air 3, hermetic sealing elements of polyisobutylene 6 being interposed between the respective opposed surfaces of the section member 4 and the inner surfaces of the glazings 1 and 2.

Cast or poured in the space between the glazings disposed outside the section members 4 is an elastomeric sealing element 7 which interconnects the various elements and completes the sealing of the volume of the layer of air 3. The elements 4, 5, 6 and 7 are conventional elements well-known in this type of construction, the materials from which they are made being adapted in the known manner for use in flame-resisting glazing.

Formed in the laminated glazing 2, preferably in proximity to one of the edges of the panel, is an orifice 8 of advantageously cylindrical shape. Extending through this orifice is a nut 9 having, adjacent to the layer of gas 3, a flange *9a* which is applied against the inner surface of the glass *2a*, preferably with interposition of a small annular sealing element 10 adapted to prevent a direct contact between the metal of the nut 9 and the glass. The nut 9 is made from a material which is fusable at a relatively low temperature of 70° to 150° C. An alloy of Wood which is fusible at a temperature of the order of a 100° C. is suitable.

Screwthreadedly engaged in the tapped hole of the nut 9 is a screw 11, for example of anodized aluminium or of steel having a treated surface, the head *11a* of which also forms a flange similar to the flange *9a* and clamps against the outer surface of the glass *2b* an annular O-section sealing element 12 of polyisobutylene. It will be understood that, when the screw is sufficiently screwed into the nut and sufficiently compresses the sealing element, the plug thus formed by the nut 9, the screw 11 and the two sealing elements 10 and 12 constitutes a hermetic obstacle preventing any communication between the layer of air and the volume outside the glass 2. On the other hand, if a fire breaks out in the volume defined by the glazing 1, the temperature of this glazing increases so that the temperature of the layer of air also increases with a simultaneous increase in the internal pressure. When the temperature starts to exceed 100° C., the nut 9 starts to melt. At this moment, the screw 11 is no longer retained and will therefore become detached, it being assisted in this respect by the overpressure prevailing in the volume 3, so that this volume is put into communication with the exterior of the glazing 2.

In order to manufacture the panel according to the invention, an orifice is formed in the laminated glazing 2 before mounting the panel and the nut 9 with its sealing element 10 is placed in position and the screw 11 is then screwed into the nut with interposition of the sealing element 12 until the required clamping effect is reached. Thereafter, the glazings 1 and 2 are assembled so as to form the panel.

Figure 2:
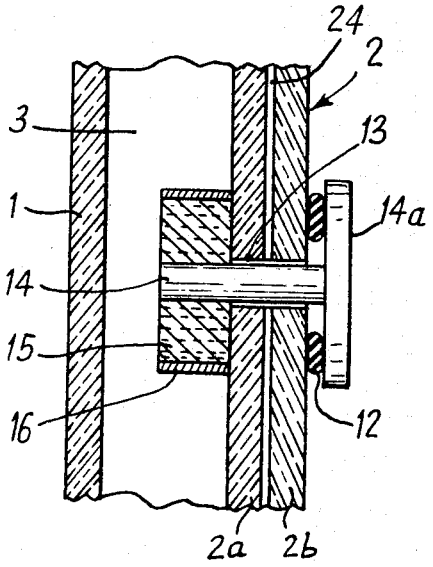
FIG. 2 is a diagrammatic sectional view of a modification of this panel.

With reference now to FIG. 2, in this embodiment there is shown a plug cooperating with an orifice 13 of smaller diameter formed in the glazing 2. Extending through the orifice 13 is a rod or stem of a member 14 having a flange *14a* with interposition of the sealing element 12. The part of the stem of the member 14 which extends into the volume 3 is embedded in a mass 15 of an alloy of Wood located within a cylindrical ring 16 of aluminium or steel. Preferably, the member 14 is also made from an alloy of Wood which provides a perfect connection between the mass 15 and the stem of the member 14.

In order to manufacture such a panel, the orifice 13 is first of all produced. With the member 14 being placed in such position that its flange *14a* is horizontal and its stem extends vertically, the glazing 2 is placed horizontally on the member 14 so as to cause the stem of this member to project through the glazing 2. The ring 16 is then placed concentrically around the stem of the member 14 and an alloy of Wood forming the mass 15 is poured or cast inside the ring 16. If the member 14 is itself made from the same alloy, there is a perfect bonding achieved by partial fusion of this member upon the casting of the mass 15 and a unit in one peice is obtained. Optionally, the stem of the member 14 may be fluted or have other projections which facilitate the fastening thereof to the cast mass 15.

Further, it will be understood that, although it is preferred to employ a metal alloy such as an alloy of Wood, it is possible in the case of FIGS. 1 and 2 to make the nuts, such as 9, or the mass, such as 15, from a synthetic thermoplastic or thermofusible material.

Figure 3:
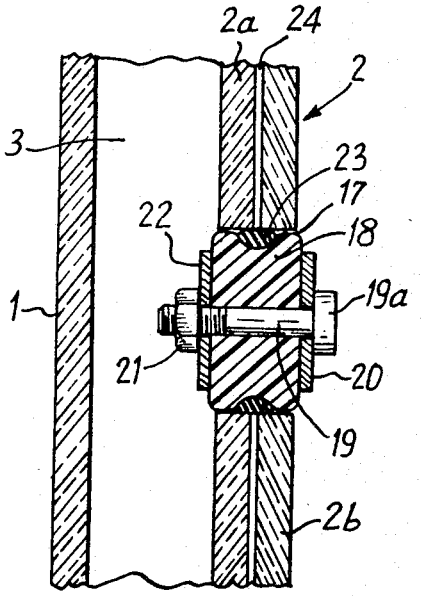
FIG. 3 is a diagrammatic sectional view of a panel according to another embodiment.

With reference now to FIG. 3, in this embodiment there has been formed in the glazing 2 an aperture 17 of large diameter. The plug is formed by a member 18 of a resilient thermoplastic material which has, at rest, an outside diameter a little less than the diameter of the aperture 17. Extending through the thermoplastic mass 18 is a bolt 19 whose head 19*a* bears against the outer surface of the mass 18 through a washer 20. A nut 21 is screwthreadedly engaged on the bolt 19 adjacent to the layer of air 3 with interposition of a washer 22. It will be understood that, when the bolt and nut are tightened together, the mass 18 is compressed and its diameter increases and its periphery then comes into tight contact with the cylindrical wall of the drilled aperture 17.

Preferably there is interposed between the periphery of the mass 18 and the wall of the aperture 17 a sealing element 23 of polyisobutylene which is crushed between the thermoplastic mass 18 and the wall of the aperture 17. The sealing element 23 may have any shape, for example it may be a cylindrical element or an O-section element and, in the latter case, there may be provided in the periphery of the mass 18, as manufactured, a groove in which the sealing element 23 is partly engaged.

The material from which the mass 18 is made is flexibly deformable and thermoplastic.

With reference now to FIGS. 4 to 7 which illustrate the successive steps in the manufacture of a panel arranged in accordance with a modification of the embodiment of FIG. 2, these figures only show the mechanically strong glazing 2 placed horizontally with the outer glass 2*b* below the inner glass 2*a*.

Figure 4:
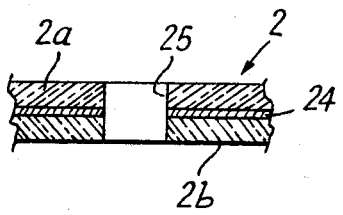
FIGS. 4 to 7 are sectional views of the mechanically strong glazing, illustrating the successive steps in the manufacture of a panel according to a third embodiment.
Figure 5:
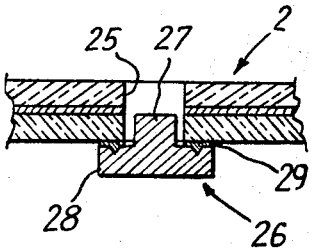

In the first step of the method illustrated in FIG. 4, an aperture 25 is formed or drilled in the glazing 2. In the second step shown in FIG. 5, a valve body 26 made from fusible alloy (alloy of Wood or a derivative thereof) is placed in position. This valve body 26 includes a stem 27 whose diameter is distinctly less than that of the aperture 25, and a head 28 whose diameter is distinctly larger than that of this aperture 25. The stem 27 is engaged in the aperture 25 and the head 28 bears against the lower surface of the glazing 2 with interposition of a sealing element 29 of polyisobutylene.

Figure 6:
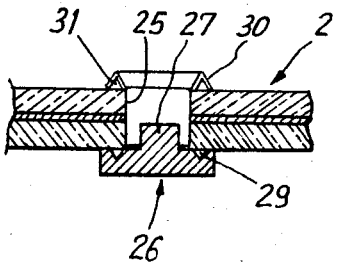

In the third step shown in FIG. 6, the glazing 2 is urged downwardly so as to compress the sealing element 29 and a washer 30 having a cup shape is placed on the top of the glazing 2 with interposition of a second sealing element 31 of polyisobutylene. The minimum inside diameter of the washer 30 is of the same order of magnitude as the diameter of the aperture 25.

Figure 7:
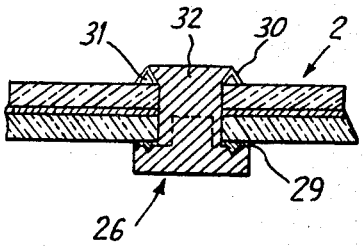

In the fourth step shown in FIG. 7, a mass of fusible alloy 32 which becomes welded to the valve body 26 is poured or cast inside the aperture 25 (in the space left free by the stem 27) and inside the washer 30.

In the final steps (not shown) of the method, the glazing 2 and the athermic glazing 1 are assembled in the manner described hereinbefore.

In this way there is obtained a panel having the feature that the plug is constituted by a mass 26, 32 of fusible material and has the shape of a rivet whose stem occupies the aperture 25 and whose opposite heads bear against the opposed surfaces of the mechanically strong glazing 2 through the medium of compressed sealing elements 29, 31.

Although the invention has been described in respect of particular embodiments, it must be understood that the scope of the invention is in no way limited thereto, it being possible to make various modifications of shape, disposition or material without departing from the scope of the invention defined in the accompanying claims.

What is claimed is:

1. A glazing panel comprising:

at least one flame-resisting first glazing for defining a volume or a premises in which a fire may break out, at least one mechanicaly strong second glazing disposed on a side of said first glazing opposite to the premises and parallel to said first glazing, a separate seating element between said first glazing and said second glazing which defines an internal hermetic volume containing a layer of gas, an aperture provided in said second glazing, and a plug made from a material which is fusible at a relatively low temperature of about 70° to 150° C. which hermetically closes said aperture.

2. A panel according to claim 1, wherein said material melts at a temperature of about 100° C.

3. A panel according to claim 1, wherein the fusible material is an alloy of Wood.

4. A panel according to claim 1, wherein the fusible material is a derivative of an alloy of Wood.

5. A panel according to claim 1, wherein the fusible material is a non-metallic synthetic thermoplastic material.

6. a panel according to claim 1, wherein the fusible material is a non-metallic thermofusible material.

7. A panel according to claim 1, wherein said plug comprises a mass of fusible material having the shape of a rivet which has a stem occupying the aperture and opposed heads which bear against opposed surfaces of the mechanically strong glazing, with interposition of compressed sealing elements between said heads and said opposed surfaces.

8. A panel according to said claim 1, wherein said plug comprises a member which extends through said aperture and includes a flange for compressing said sealing element, said member having an extension which projects from an opposed side of the mechanically strong glazing relative to said flange and a cast and solidified mass surrounding and in contact with said extension.

9. A panel according to claim 8, comprising a ring in which said mass is cast, said ring being suitably disposed against the corresponding surface of the mechanically strong glazing during the casting operation.

10. A panel according to claim 1, wherein said aperture has a cylindrical wall, said plug has a body which is expansible radially of said aperture and a rod extends through said body and is combined with two flanges which are disposed adjacent opposed ends of said body, and screw means are provided for urging said flanges towards each other so as to produce an expansion of said body radially of said aperture which puts said body in contact with the cylindrical wall of said aperture.

11. A panel according to claim 10, comprising a sealing element disposed on the periphery of said body between said body and said cylindrical wall of said aperture.

12. A panel according to claim 1, wherein said plug has, on each side of the mechanically strong glazing, two flanges which bear against said mechanically strong glazing, at least one sealing element being interposed between at least one of said flanges and the mechanically strong glazing, and means interconnecting the two flanges so as to compress said sealing element.

13. A panel according to claim 12, wherein the plug comprises a nut which has a flange and extends through said aperture, a screw being screwthreadedly engaged in the nut so as to compress said sealing element.

14. A panel according to claim 12, wherein the sealing element is made from a non-bonded material.

15. A panel according to claim 12, wherein the sealing element is made from a non-adhesive material.

16. A panel according to claim 12, wherein the sealing element is made from polyisobutylene.

* * * * *